US011283202B1

(12) United States Patent
Chen

(10) Patent No.: US 11,283,202 B1
(45) Date of Patent: Mar. 22, 2022

(54) TERMINAL BLOCK WITH PRESSING KEYS FOR WIRE CONNECTION

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 17/123,127

(22) Filed: Dec. 16, 2020

(30) Foreign Application Priority Data

Oct. 28, 2020 (CN) ..... 202022444861.2

(51) Int. Cl.
*H01R 9/24* (2006.01)

(52) U.S. Cl.
CPC ..... *H01R 9/2416* (2013.01)

(58) Field of Classification Search
CPC ..... H01R 9/2416; H01R 4/4836
See application file for complete search history.

(56) References Cited

U.S. PATENT DOCUMENTS 8,262,405 B1 * 9/2012 Bishop ..... H01R 4/4836 439/439
2014/0256170 A1 * 9/2014 Cheng ..... H01R 9/24 439/345

* cited by examiner

*Primary Examiner* — Vanessa Girardi

(57) ABSTRACT

A terminal block for wire connection is provided, including a casing and a wire clamping body arranged in the casing; the casing includes a first casing and a second casing, and the first casing and the second casing are respectively configured with pressing keys, each of the pressing keys is configured to press the wire clamping body, so as to trigger closing or opening of the wire clamping body to make wires is switched between the clamping state and the detachable state, wherein the wires is inserted into the wire clamping body along one side of the first casing or the second casing. The first casing and the second casing are aligned and abutted with each other to form a space for holding the wire clamping body, so as to assemble the wire clamping body in the casing.

6 Claims, 6 Drawing Sheets

TERMINAL BLOCK WITH PRESSING KEYS FOR WIRE CONNECTION

CROSS REFERENCE TO RELATED APPLICATION

This application claims all benefits accruing under 35 U.S.C. § 119 from China Patent Application No. 202022444861.2, filed on Oct. 28, 2020 in the China National Intellectual Property Administration, the content of which is hereby incorporated by reference.

TECHNICAL FIELD

The disclosure relates to the technical field of wire connection, in particular to a terminal block for wire connection.

BACKGROUND

The terminal is used for external wire connection, which is an important part of wire connection. At present, the way the terminals connect wires are by clamping the wires by tightening fasteners, or by clamping the wires with an elastic piece. The tightening method can effectively compress the wire, but the tightening operation is more troublesome and the wiring process is inconvenient. In most cases, the terminal block that clamps the wires with an elastic piece is used.

At present, the terminal blocks on the market are used to clamp the external wires through the elastic piece. However, the trigger mode of the elastic piece is limited, and the operation of inserting and pulling out the wires is inconvenient, has many steps, complicated installation, and other problems, which makes it difficult to improve the efficiency and meet the requirements of fast connecting wires. Moreover, wiring can only be carried out in the same direction of the casing, which does not meet the situation of multi-directional wiring.

SUMMARY

The disclosure discloses a terminal block for wire connection, which is simple in structure, convenient in operation and aims at improving the problems of inconvenient operation and connection difficulty of existing terminal blocks.

An embodiment of a terminal block for wire connection includes a casing and a wire clamping body arranged in the casing for clamping external wires. The casing includes a first casing component and a second casing component, wherein the first casing component and the second casing component are aligned and abutted with each other to form a space for holding the wire clamping body. The first casing component and the second casing component are configured with pressing keys. Each of the pressing keys is configured to press the wire clamping body, so as to trigger closing or opening of the wire clamping body, and so that wires inserted into the wire clamping body along one side of the first casing or the second casing is switched between the clamping state and the detachable state.

As a further improvement, the wire clamping body includes a metal frame and an arc-shaped spring piece. The metal frame is approximately rectangular shaped and the arc-shaped spring piece is configured within the metal frame. The arc-shaped spring piece is always elastically abutted with the metal frame when the arc-shaped spring piece is in an initial state, so as to close the wire clamping body, and so that the metal part of the external wires is correspondingly clamped between the arc-shaped spring piece and the metal frame.

As a further improvement, the arc-shaped spring piece is a strip body with two warped ends, and one side edge of the metal frame is fastened by snap-fit for opening and closing correspondingly, so that the strip body is elastically snapped and horizontally clamped in the metal frame. The pressing key is provided with a pressing portion protruding towards the arc-shaped spring piece, and the pressing portion is correspondingly extended to abut and press the warped end of the arc-shaped spring piece to open the wire clamping body when the pressing key is controlled by an external force.

As a further improvement, the pressing portion is integrally formed on the pressing key, a cross section of the pressing portion is approximately triangle shaped, and at least one top corner of the pressing portion faces one side of the arc-shaped spring piece.

As a further improvement, the first casing, second casing and the metal frame are provided with through holes corresponding to the pressing key, and one of a plurality of outer edges of the pressing portion is provided with an inverted hook portion which facilitates an outer circumference of the pressing portion to guide into the metal frame along the through hole.

As a further improvement, the two warped ends of the arc-shaped spring piece are respectively located at different casings and are warped towards a direction where pressing the key is located. One end of the warped end is bent toward a bottom plate of the arc-shaped spring piece with a preset obtuse angle, and the other end of the warped end is inclined to extend and form a preset acute angle with the bottom plate, so that the warped end is approximately U-shaped hook. The metal frame is limited in the casing by the warped end partially exposed outside the metal frame when the arc-shaped spring piece is clamped in the metal frame.

As a further improvement, insertion holes communicated with the wire clamping body are arranged at outer sides of the two casings, and an interior part of the metal frame and each of the insertion holes are communicated with each other. The insertion hole is configured to accommodate at least two different external wires at the same time, so as to be independently inserted into the wire clamping body, and so that the external wires are electrically connected to each other.

As a further improvement, the first casing and the second casing are provided with at least one pressing key along the direction of the insertion hole, and the two pressing keys respectively located at the first casing component and the second casing component in the same direction are inclined arranged in a way opposite to each other and close to a position where the two casings are clamped and abutted.

As a further improvement, the pressing key is elastically connected with the casing in a form of piece with gradient change, so that the pressing key is rotatable relative to the casing when the pressing key is controlled by external force.

As a further improvement, the casing includes a bottom casing assembled and installed with the first casing and the second casing. Specifications of the first casing component and the second casing component are the same and are symmetrically arranged on the bottom casing by snap-fit, correspondingly enclosing the space, so that the wire clamping body is detachable and placed in the casing.

By adopting the above technical solution, the disclosure can obtain the following technical effects.

The terminal block for wire connection of the application forms a space to accommodate the wire clamping body through the alignment and abutting of the first casing and the second casing, so that the wire clamping body is assembled in the casing, which is convenient for clamping and inserting the external wires. Each casing is equipped with a pressing key, and the pressing key configured for pressing to trigger the opening or closing of the wire clamping body, so that when the pressing key is controlled by external force, the wire inserted into the casing can be clamped to realize electrical connection or the clamping can be released, thereby facilitating rapid insertion or disconnection of the wire. The casing is divided into the first casing component and the second casing component, and the first casing component and the second casing component are aligned and abutted to form an accommodation space, which is simple in structure and easy to disassemble and assemble. Moreover, the two sides of the first casing component and the second casing component can be connected with multiple wires, which is convenient for wiring and suitable for various occasions.

BRIEF DESCRIPTION OF THE DRAWINGS

In order to illustrate the technical solutions of the embodiments of the present disclosure more clearly, the drawings used in the embodiments will be briefly described below. It shall be understood that the following drawings illustrate only certain embodiments of the present disclosure. Therefore, it should not be deemed as limiting the scope, and those skilled in the art may obtain other related drawings according to these drawings without any creative work.

DETAILED DESCRIPTION OF THE EMBODIMENTS

Figure 1:
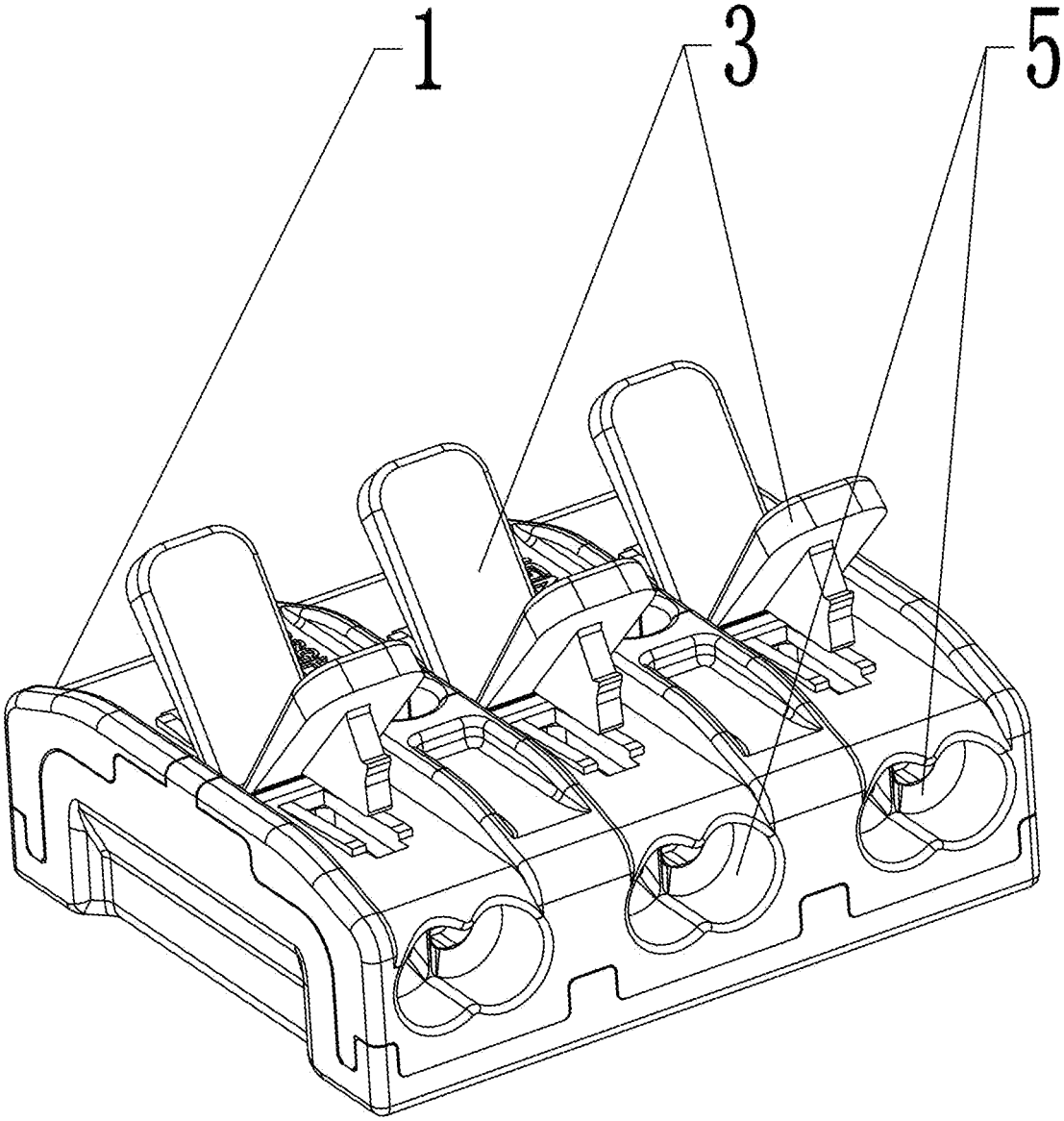
FIG. 1 is a perspective view showing a terminal block for wire connection of the embodiment of the disclosure.
Figure 2:
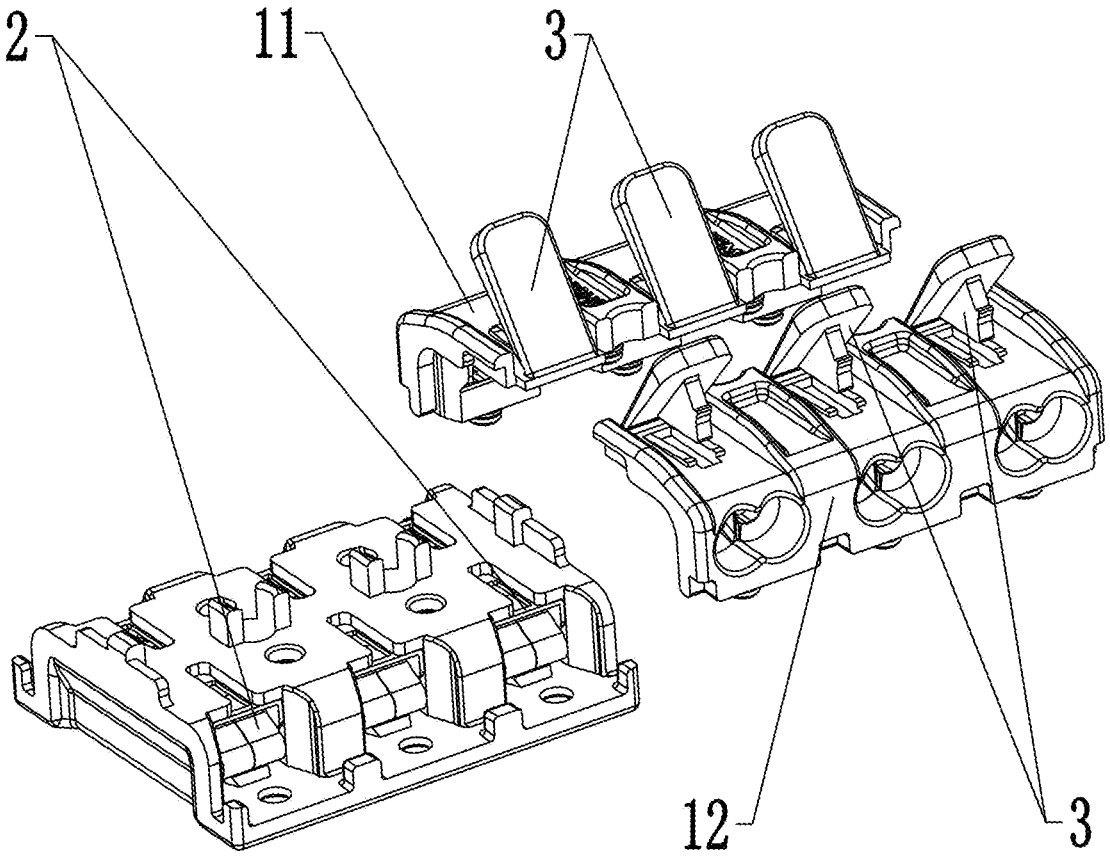
FIG. 2 is a partially exploded view of the terminal block for wire connection in FIG. 1 under one of the perspectives.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure.

Embodiment

Combined with FIGS. 1 to 8, the present embodiment provides a terminal block, which includes a casing 1 and a wire clamping body 2. The wire clamping body 2 is arranged in the casing 1 for clamping the external wires. The casing 1 includes a first casing component 11 and a second casing component 12. The first casing component 11 and the second casing component 12 are aligned and abutted with each other to form a space for holding the wire clamping body 2. The first casing component 11 and the second casing component 12 are both provided with a pressing key 3, and each pressing key 3 respectively presses the wire clamping body 2 to trigger the closing or opening of the wire clamping body 2, so that the wire can be switched between the clamping state and the detachable state. The wire is inserted into the wire clamping body 2 along one side of the first casing component 11 or the second casing component 12.

In this embodiment, the first casing component 11 and the second casing component 12 are aligned and abutted with each other to form the space for holding the wire clamping body 2, so that the wire clamping body 2 is assembled in the casing 1, which is convenient for clamping and inserting the external wires. Each casing is provided with the pressing key 3 for pressing the wire clamping body 2, so as to trigger the opening or closing of the wire clamping body 2. When the pressing key 3 is controlled by an external force, the wire inserted into the casing 1 can be clamped to realize electrical connection, or the clamping of the wire can be released to facilitate quick insertion or disconnection of the wire, so that the wiring or disconnection operation is very simple. The first casing component 11 and the second casing component 12 make the space of the casing 1 in the form of a box, and the structure is simple and convenient for disassembly and assembly, which is conducive to production and manufacturing and reduces the production cost, use cost, and is conducive to popularization and application. Moreover, the two sides of the first casing component 11 and the second casing component 12 can be connected with a plurality of wires, so the wiring is convenient and suitable for various occasions.

The pressing key 3 in one of the casing components 11, 12 is driven by the external force when wired, so as to open the wire clamping body 2, and secure the external wire in the wire clamping body 2 along one side of the casing 1. Removing the external force applied to the press key 3 on the casing 1, closes the wire clamping body 2 to clamp the wire in the wire clamping body 2, so that the wire is in clamping state to realize the electrical connection. It is easy to operate and does not require removal of the two casings aligned and abutted to each other, so as to improve the efficiency of the wire connection. To disconnect the wire, the pressing key 3 on the casing is pressed to trigger the wire clamping body 2 to open, so that the wire is now in a detachable state, and can be pulled out of the casing 1. The terminal block of the application has the advantages of simple connection or disconnection, simple structure and convenient operation, which allows fast insertion of external wires in the terminal.

In one embodiment, the wire clamping body 2 includes a metal frame 21 and an arc-shaped spring piece 22. The metal frame 21 is approximately rectangular shaped, and the arc-shaped spring piece 22 is elastically arranged in the metal frame 21. The arc-shaped spring piece 22 is always elastically abutted with the metal frame 21 when the arc-shaped spring piece is in the initial state, so as to close the wire clamping body 2, so that the metal part of the external wire is correspondingly clamped between the arc-shaped spring piece 22 and the metal frame 21. When the wire clamping body 2 is opened, the external wire is inserted between the arc-shaped spring piece 22 and the metal frame 21, and when the external force is removed, the metal spring piece reset to the initial state can clamp and fasten the wire, so as to realize the effective electrical connection of multiple external wires in the metal frame 21.

In one embodiment, the arc-shaped spring piece 22 is a strip body with two warped ends, and one side edge 211 of the metal frame 21 is fastened by snap-fit, so that the strip body can be elastically snapped to the metal frame 21 by opening and closing, and the strip body is horizontally clamped in the metal frame 21. Specifically, the metal frame 21 is a rectangular body with hollow interior and opening at both ends. The metal frame 21 can fasten and assemble the arc-shaped spring piece 22 in the elastic clamping way. Through the mutual snap-fit at one side edge 211 of the rectangular body, the metal frame 21 with elastic force can be opened along the side edge 211 under the action of an external force, so as to expend the internal capacity of the rectangular body, such that the internal capacity is enlarged to facilitate the assembly and installation of the arc-shaped spring piece 22. After the installation is completed, the side edge 211 is pressed to make the side edge 211 fit tightly, so as to ensure the stability of the metal frame 21, and clamp the arc-shaped spring piece 22 in the metal frame 21 elastically. In particular, the two warped ends of the arc-shaped spring piece 22 are facing one end surface of the metal frame 21, so as to allow the external wire to be inserted between the end of the arc-shaped spring piece 22 and the end surface of the metal frame 21 which is directly opposite to the arc-shaped spring piece 22 when the wire clamping body 2 is opened.

In one embodiment, further, the pressing key 3 is provided with a pressing portion 31 protruding towards the arc-shaped spring piece 22. The pressing portion 31 can correspondingly extend to butt and press the warped end 221 of the arc-shaped spring piece 22 to open the wire clamping body 2 when the pressing key 3 is controlled by an external force. Under the pressure of the pressing portion 31, the warped end 221 of the arc-shaped spring piece 22 is relatively far away from the end surface of the metal frame 21 which is directly opposite to the arc-shaped spring piece 22, such that the clamping of the arc-shaped spring piece 22 to the wire is released, triggering the wire in a detachable state. The pressing portion 31 is integrally formed on the pressing key 3, and the cross section of the pressing portion 31 is approximately a triangle, and at least one top corner of the pressing portion 31 is toward one side of the arc-shaped spring piece 22. When the pressing key 3 moves downward towards the arc-shaped spring piece 22 under the control of external force, the top corner of the pressing portion 31 can be directly against with the warped end 221 of the arc-shaped spring piece 22, thus reducing the downward pressure range of the pressing key 3 and ensuring the effective opening and closing of the wire clamping body 2.

It should be mentioned that the first casing 11, the second casing 12 and the metal frame 21 are provided with through holes 4 corresponding to the pressing key 3. One of the outer edges of the pressing portion 31 is provided with an inverted hook portion 32 to facilitate the outer circumference of the pressing portion 31 to guide into the metal frame 21 along the through hole 4. The through holes 4 can allow the pressing portion 31 to enter into the metal frame 21 along the pressing direction, so as to avoid the pressing portion 31 of the pressing key 3, and the pressing portion 31 can enter into the metal frame 21 more smoothly and stably by using of the inverted hook portion 32, so as to carry out the pressing deformation on the warped end 221 of the arc-shaped spring piece 22.

Referring to FIGS. 3 to 7, in one embodiment, the two warped ends 221 of the arc-shaped spring piece 22 are respectively located at different casing components 11, 12, and are warped toward the direction of pressing the key 3. Specifically, one end of the warped end 221 is bent toward the bottom plate 22 of the arc-shaped spring piece 22 with a preset obtuse angle, and the other end of the warped end is inclined to extend and form a preset acute angle with the bottom plate 222, so that the warped end 221 is approximately U-shaped hook; and the metal frame 21 is limited in the casing 1 by the warped end 221 partially exposing outside the metal frame 21 when the arc-shaped spring piece 22 is clamped in the metal frame 21. Preferably, the warped end 221 is bent downward along the bottom plate 222 to form an obtuse angle with the lower side surface of the bottom plate 222. The obtuse angle can be in a range between 145° and 175° and the warped end 221 can be bent in the form of a U-shaped hook, so that an acute angle is formed between the other end of the warped end 221 and the upper side surface of the bottom plate 222. The angle range of the acute angle is between 45° and 75° and the sum of the acute angle and the obtuse angle formed is greater than 180°, so as to determine the end of the warped end 221 which is close to the pressing key 3 has an elastic resistance force close to the corresponding metal frame 21, to improve the clamping and fastening effect of the wire clamping body 2 to the external wire. In addition, the warped end 221 is at least partially exposed to both sides of the opening of the metal frame 21, so that the metal frame 21 can be further stably confined in the holding space formed by the two casing components 11, 12 through the two warped ends 221 with elastic pressing force when the wire clamping body 2 is assembled in the casing 1. The low position of the warped end 221 can be basically flush with the bottom surface of the metal frame 21, so that the metal frame 21 can be stably arranged in the casing 1 under the elastic pressing of the two warped ends 221.

In one embodiment, insertion holes 5 in communication with the wire clamping body 2 are arranged at the outer sides of the two casing components 11, 12, and the interior part of the metal frame 21 and each of the insertion holes 5 are in communication with each other. In particular, the insertion hole 5 is configured to accommodate at least two different external wires at the same time, so as to be independently inserted into the wire clamping body 2, so that the external wires are electrically connected to each other, which can connect multiple wires on both sides of the casing 1 to meet the different demands of various wiring occasions.

In one embodiment, specifically, the first casing component 11 and the second casing component 12 are provided with at least one pressing key 3 along the direction of the insertion hole 5, and the two pressing keys 3 respectively located at the first casing component and the second casing component in the same direction are inclined arranged in a way opposite to each other and close to a position where the two casings are clamped and abutted. Therefore, the casing 1 is equipped with the pressing keys 3 on different casings in the same direction of wire insertion, so as to realize independent wiring control, and ensure the different states of external wires on different sides on the casing 1, such that diversified wire clamping methods is realized. In addition, the pressing keys 3 which are arranged on separated casing are opposite to each other and inclined, so that each pressing key 3 is centrally arranged at the joint of the two casings, which is convenient for pressing operation and does not occupy space.

In one embodiment, the pressing key 3 is elastically connected with the casing in a form with a gradient change, so that the pressing key 3 is rotate relative to the casing when the pressing key is controlled by external force. Along the direction from the casing to the pressing key 3, the thickness of the elastic piece 6 at the joint is gradually increased, so that the pressing key 3 can press elastically at the joint and return to the initial inclined position after the pressing pressure is removed, so as to ensure the fatigue strength of the joint meets the requirements of multiple times of pressing. In particular, the pressing key 3, the elastic piece 6 and the casing are all integrated in one molding setting. It should be noted that in other embodiments, the pressing key 3 can also be arranged on the casing in an elastic hinged way which is split configuration with the casing, as long as the pressing key 3 can be controlled by external force to trigger the opening and closing of the wire clamping body 2.

Figure 3:
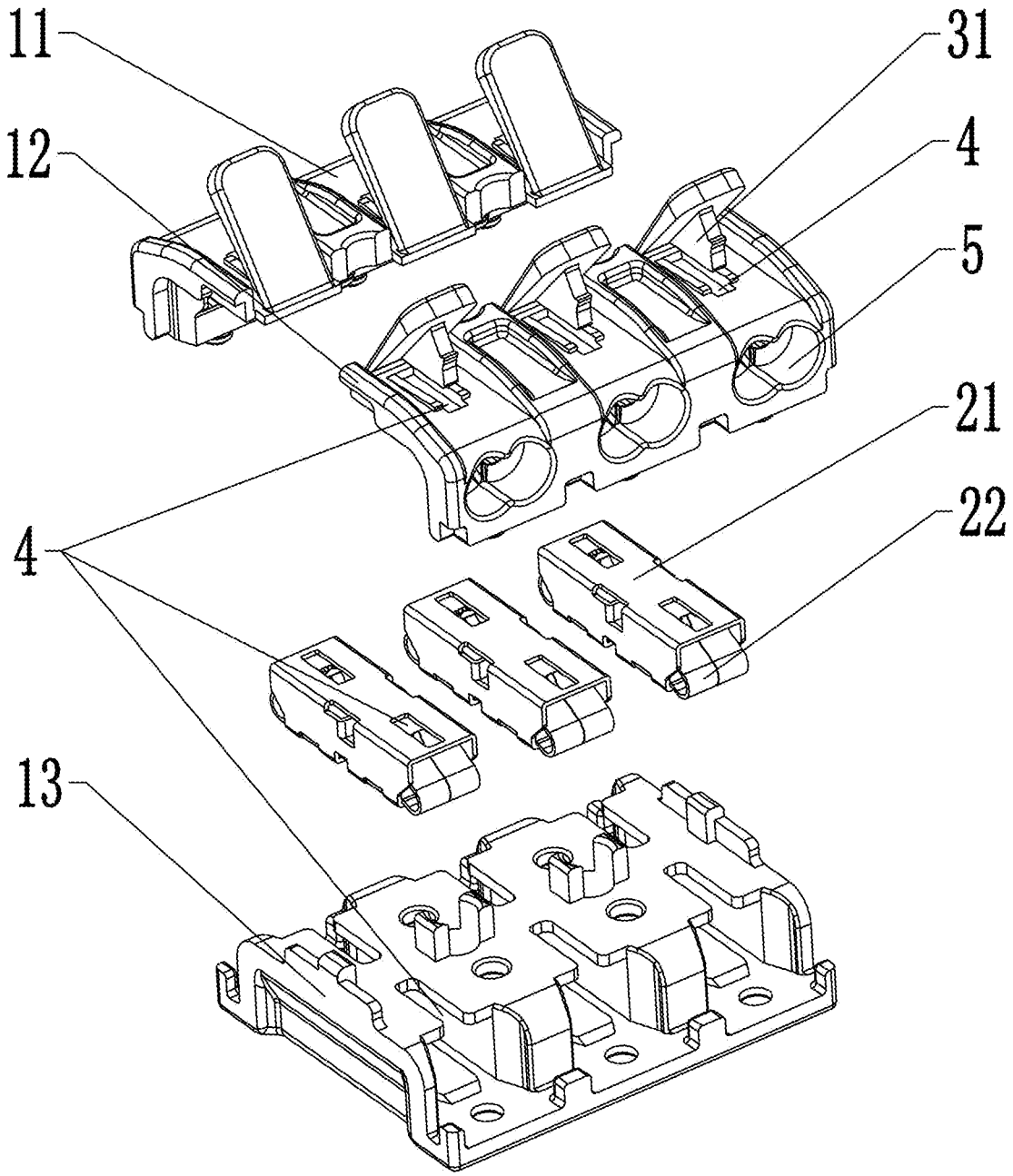
FIG. 3 is a partially exploded view of the terminal block for wire connection in FIG. 1 under the other of the perspectives.
Figure 4:
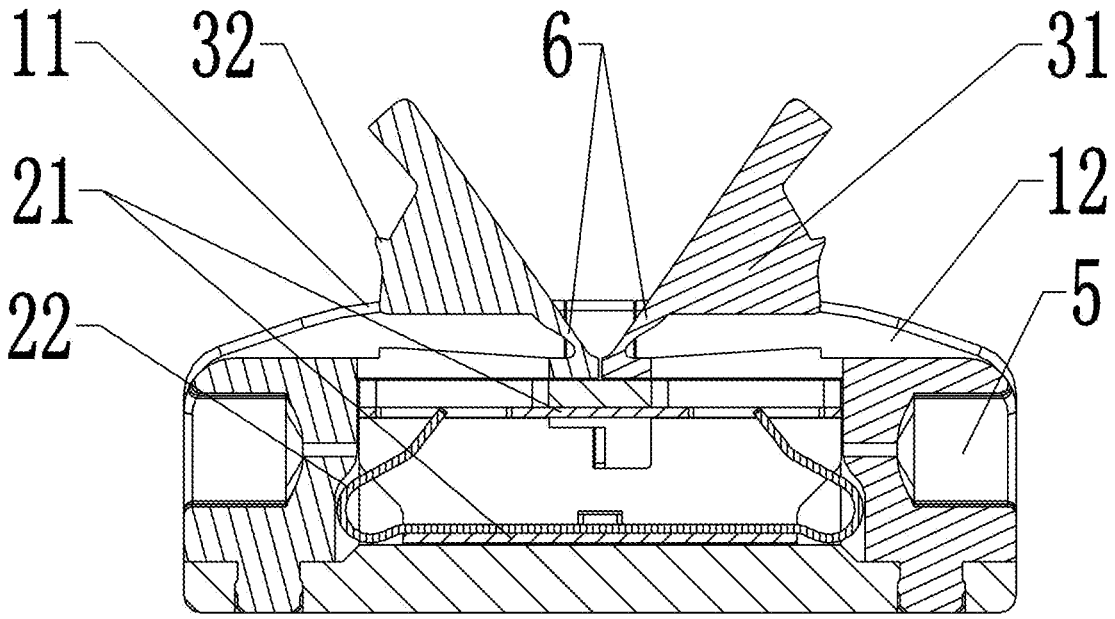
FIG. 4 is a sectional view of the terminal block for wire connection of the embodiment of the disclosure.
Figure 5:
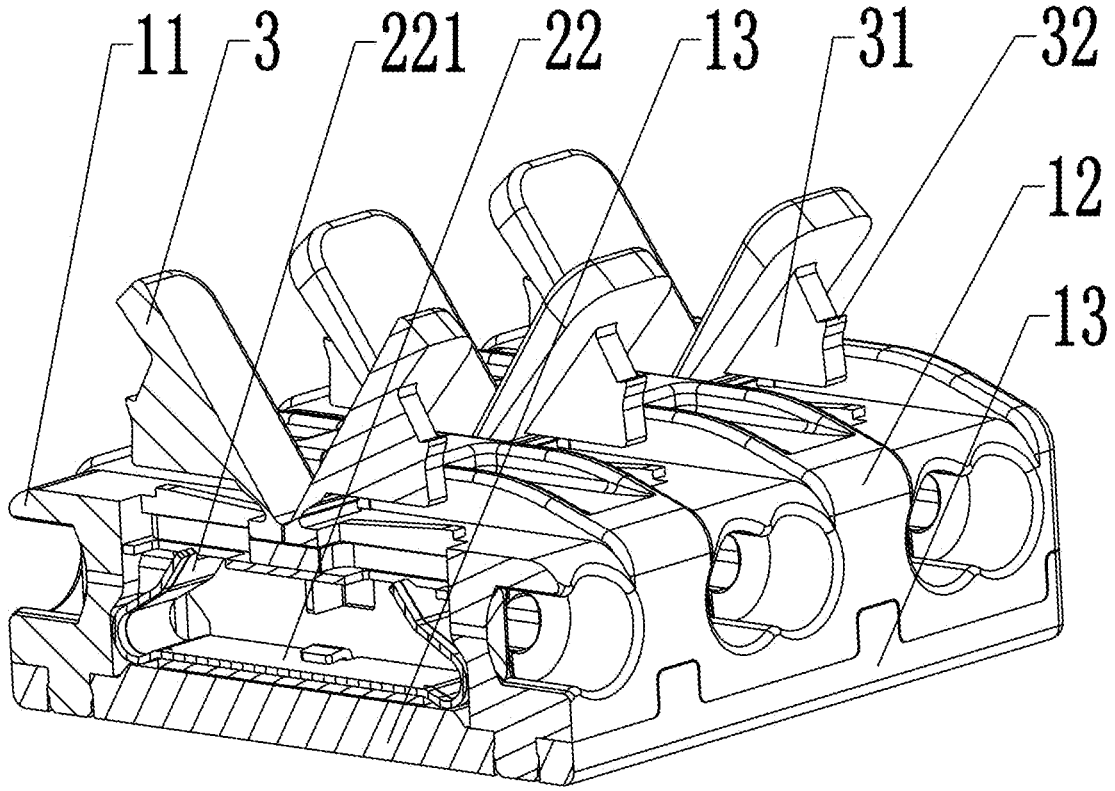
FIG. 5 is a sectional view of the terminal block for wire connection in FIG. 4 from other perspective.
Figure 6:
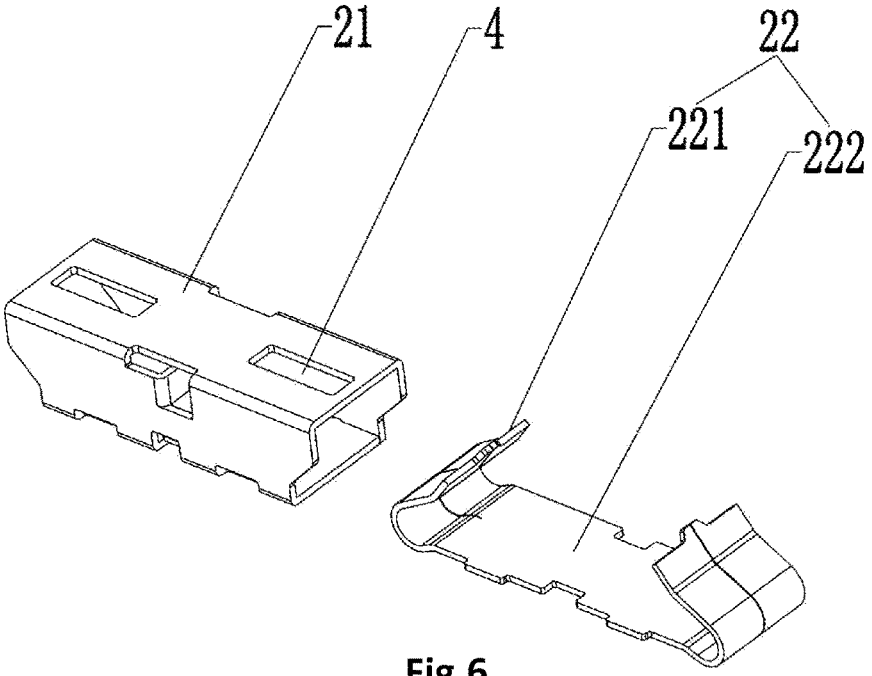
FIG. 6 is an exploded view of a clamp body of the terminal block for wire connection according to the embodiment of the disclosure.
Figure 7:
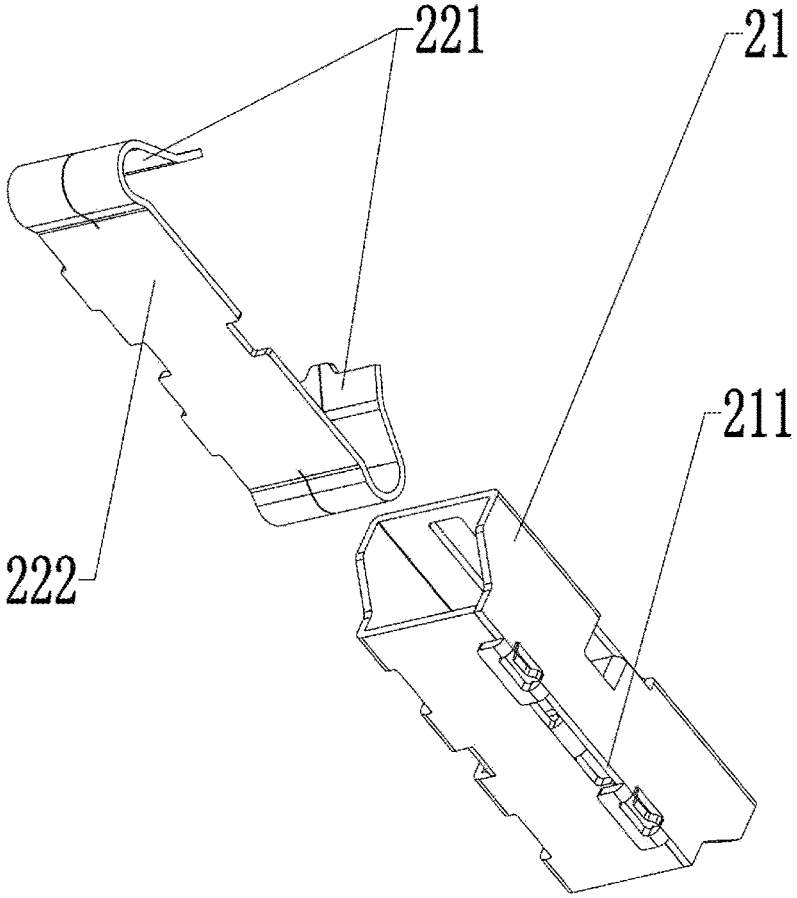
FIG. 7 is an exploded view of the terminal block for wire connection in FIG. 6 from other perspective.
Figure 8:
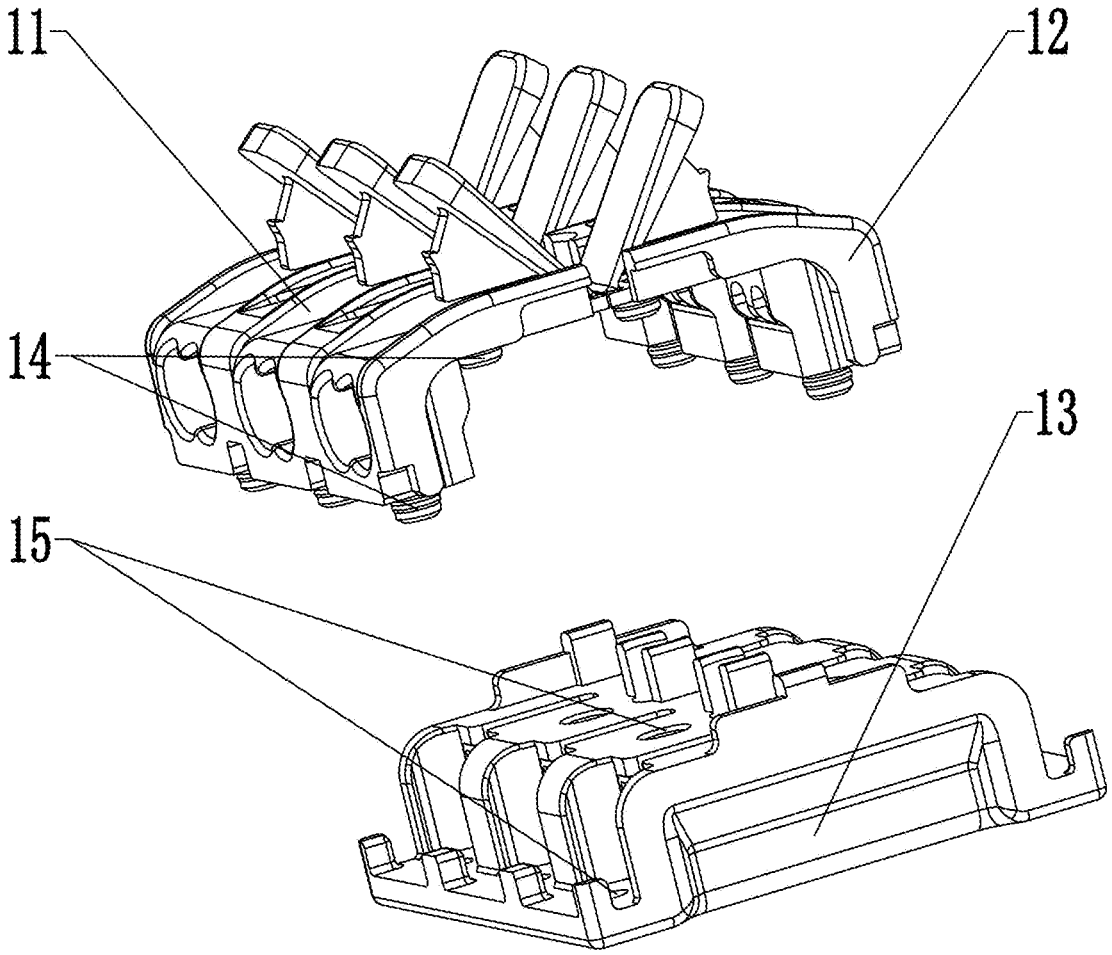
FIG. 8 is a partial exploded view of the terminal block for wire connection of the embodiment of the disclosure from another perspective.

Referring to FIG. 3, FIG. 5 and FIG. 8, in one embodiment, the casing 1 further includes a bottom casing 13. The bottom casing 13 is assembled and installed with the first casing 11 and the second casing 12, and the specifications of the two casings are the same and the first casing 11 and the second casing 12 are symmetrically arranged on the bottom casing 13 by a snap-fit, correspondingly enclosing the space, so that the wire clamping body 2 is detachable and placed in the casing 1. The bottom casing 13 is a base, and the two casings can be clamped and assembled with the bottom. Specifically, the first casing 11 and the second casing 12 can be manufactured by using the same mold for two casings with the same specification through one mold opening, which greatly facilitates mass production and manufacturing. The cross sections of the two casings are L-shaped, and the contact surfaces toward the bottom casing component 13 are protruded and provided with a plurality of mounting bosses 14, and the bottom casing component 13 is correspondingly provided with mounting holes 15 matching with the mounting bosses 14, so as to realize the detachable male and female clamping assembly. Moreover, the cross section formed by the first casing component 11 and the second casing component 12 assembled on the casing 1 is in the shape of "E", and the bottom casing component 13 is enclosed in the opening of the "E" structure, so as to enclose the space for holding the wire clamping body 2 and enhance the tightness of the casing 1.

It should be mentioned that, in particular, at least a plurality of insertion holes 5 are arranged on the outer sides of each casing, and the wire clamping body 2 is arranged in the direction of each insertion hole 5.

The above is only some embodiments of the present disclosure, and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A terminal block for wire connection, comprising a casing and a wire clamping body arranged in the casing; the casing comprises a first casing component and a second casing component, wherein the first casing component and the second casing component are aligned and abutted with each other to form a space for holding the wire clamping body, and the first casing component and the second casing component are configured with pressing keys, each of the pressing keys is configured to press the wire clamping body, so as to trigger closing or opening of the wire clamping body, so that wires inserted into the wire clamping body along one side of the first casing component or the second casing component is switched between the clamping state and the detachable state;

wherein the wire clamping body comprises a metal frame having an approximately rectangular shape and an arc-shaped spring piece configured within the metal frame; the arc-shaped spring piece is always elastically abutted with the metal frame when the arc-shaped spring piece is in an initial state, so as to close the wire clamping body;

the arc-shaped spring piece is a strip body with two warped ends, one side edge of the metal frame is fastened by snap-fit for opening and closing correspondingly, so that the strip body is elastically snapped and horizontally clamped in the metal frame; the pressing key is provided with a pressing portion protruding towards the arc-shaped spring piece, the pressing portion is correspondingly extended to butt and press the warped end of the arc-shaped spring piece to open the wire clamping body when the pressing key is controlled by an external force;

the pressing portion is integrally formed on the pressing key, and a cross section of the pressing portion is approximately a triangle, and at least one top corner of the pressing portion faces one side of the arc-shaped spring piece; and the first casing component, the second casing component and the metal frame are provided with through holes corresponding to the pressing key, and one of a plurality of outer edges of the pressing portion is provided with an inverted hook portion which facilitates an outer circumference of the pressing portion to guide into the metal frame along the through hole.

2. The terminal block for wire connection according to claim 1, wherein the casing comprises a bottom casing component assembled and installed with the first casing component and the second casing component; specifications of the first casing component and the second casing component are the same and are symmetrically arranged on the bottom casing component by snap-fit, correspondingly enclosing the space, so that the wire clamping body is detachable and placed in the casing.

3. The terminal block for wire connection according to claim 1, wherein the two warped ends of the arc-shaped spring piece are respectively located at the first casing component and the second casing component and are warped towards a direction where pressing the key is located; one end of the warped end is bent toward a bottom plate of the arc-shaped spring piece with a preset obtuse angle, and the other end of the warped end is inclined to extend and form a preset acute angle with the bottom plate, so that a shape of the warped end is approximately a U-shaped hook; and the metal frame is limited in the casing by the warped end partially exposing outside the metal frame when the arc-shaped spring piece is clamped in the metal frame.

4. The terminal block for wire connection according to claim 3, wherein insertion holes in communication with the wire clamping body are arranged at outer sides of the two casings, and an interior part of the metal frame and each of the insertion holes are in communication with each other.

5. The terminal block for wire connection according to claim 4, wherein the first casing component and the second casing component are provided with at least one pressing key along the direction of the insertion hole, and the two pressing keys respectively located at the first casing component and the second casing component in the same direction are inclined arranged in a way opposite to each other and close to a position where the first casing component and the second casing component are clamped and abutted.

6. The terminal block for wire connection according to claim 5, wherein the pressing key is elastically connected with the casing in a form of a piece with a gradient change, so that the pressing key is rotate relative to the casing when the pressing key is controlled by external force.

* * * * *